US008768224B2

(12) United States Patent
Yamaguchi et al.

(10) Patent No.: US 8,768,224 B2
(45) Date of Patent: Jul. 1, 2014

(54) DEVELOPING DEVICE, IMAGE FORMING APPARATUS, AND DEVELOPING METHOD

(75) Inventors: Daichi Yamaguchi, Kanagawa (JP); Katsuhiro Aoki, Kanagawa (JP); Akihiro Kawakami, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 182 days.

(21) Appl. No.: 13/365,852

(22) Filed: Feb. 3, 2012

(65) Prior Publication Data

US 2012/0213557 A1 Aug. 23, 2012

(30) Foreign Application Priority Data

Feb. 23, 2011 (JP) ..... 2011-037550

(51) Int. Cl.
*G03G 15/09* (2006.01)

(52) U.S. Cl.
USPC ..... 399/269; 399/270

(58) Field of Classification Search
USPC ..... 399/269, 270
See application file for complete search history.

(56) References Cited

U.S. PATENT DOCUMENTS 6,282,385 B1 * 8/2001 Suto ..... 399/55
6,282,393 B1 * 8/2001 Fujita ..... 399/270
7,209,699 B2 4/2007 Yamaguchi et al.
8,285,164 B2 * 10/2012 Imura et al. ..... 399/55
2005/0191099 A1 9/2005 Yamaguchi et al.
2011/0097116 A1 * 4/2011 Itagaki et al. ..... 399/269

FOREIGN PATENT DOCUMENTS

JP 04-184375 A 7/1992
JP 2000-172064 A 6/2000
JP 2002-196572 A 7/2002
JP 2003-149927 A 5/2003

* cited by examiner

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

A developing device includes: a first developer carrier that is moved in a same direction as a moving direction of a latent image carrier at a faster linear speed than the latent image carrier; a second developer carrier that further develops the obtained toner image and that is moved in a same direction at a faster linear speed than the latent image carrier; and a bias output unit that outputs a developing bias to be applied to the second developer carrier. The developing bias includes a direct-current component and a non-rectangular alternating-current component whose waveform has a gentle edge at which a direction of an electric field between the second developer carrier and a background portion of the latent image carrier is changed to a direction in which the toner is moved from the background portion toward the second developer carrier.

20 Claims, 8 Drawing Sheets

Vpp=800 [V], FREQUENCY f=9 [kHz], duty=50 [%]

Vpp=800 [V], FREQUENCY f=9 [kHz]

Vpp=800 [V], FREQUENCY f=9 [kHz]

Vpp=800 [V], FREQUENCY f=9 [kHz], duty=50 [%]

DEVELOPING DEVICE, IMAGE FORMING APPARATUS, AND DEVELOPING METHOD

CROSS-REFERENCE TO RELATED APPLICATIONS

The present application claims priority to and incorporates by reference the entire contents of Japanese Patent Application No. 2011-037550 filed in Japan on Feb. 23, 2011.

BACKGROUND OF THE INVENTION

1. Field of the Invention

The present invention relates to a developing device for developing a latent image on a latent image carrier, an image forming apparatus including the developing device, and a developing method for developing the latent image.

2. Description of the Related Art

In recent years, as the printing speed becomes faster, the surface of a latent image carrier such as a photosensitive element tends to move at a higher speed. In such a high-speed image forming apparatus, unless the surface of a developer carrier moves at a high speed, the insufficient amount of toner is supplied per unit time to a developing region where the latent image carrier faces the developer carrier. As a result, a developing density deficiency may occur. For example, when a developing sleeve formed of a rotatable non-magnetic pipe is used as the developer carrier, unless the developing sleeve rotates at a high speed so that the surface thereof could move at a high speed, the insufficient amount of toner is supplied to the developing region. However, when the developing sleeve rotates at a high speed, the developer on the developing sleeve promotes the action of scraping the toner off the latent image carrier. As a result, the reproducibility of narrow-line images deteriorates.

In view of this problem, an image forming apparatus is known in which the latent image on a latent image carrier is developed by a plurality of developing sleeves. In the image forming apparatus of this type, a toner image obtained by a first developing process using a first developing sleeve is further developed by a second developing process using a second developing sleeve. A developing bias in which an alternating-current component formed by rectangular waves is superimposed on a direct-current component is applied to each of the first and second developing sleeves. In such a configuration, even when the toner image obtained by the first developing process has a developing density deficiency caused by an insufficient amount of the supplied toner, since the toner image is further developed by the second developing process, the toner image's density may be increased. In addition, in each developing process, compared to the case of applying a developing bias including only a direct-current component, in the case of applying a developing bias including both an alternating-current component and a direct-current component, the toner in the developer is more likely to move toward the latent image. In this way, developing efficiency is improved. As a result, the developing density deficiency may be suppressed without rotating the developing sleeve at a high speed.

As shown above, in a method of developing using a plurality of developing sleeves, it is a common practice to move the surface of the developing sleeve in the developing region in the same direction as the surface of the latent image carrier and to set the linear speed of the developing sleeve to be faster than the linear speed of the latent image carrier. This is based on the reasons described below. That is, when the surface of the developing sleeve in the developing region moves in the direction reverse to a moving direction of to the surface of the latent image carrier, the latent image carrier slightly brushes the developer rotating with the developing sleeve, thereby exerting a force, to the developer, which tends to move the developer in a direction reverse to the rotating direction of the developer. As a result, the force prevents the developer from rotating with the developing sleeve so that the developer stays in the developing region for a long period of time, which causes developing defects. Thus, the surface of the developing sleeve and the latent image carrier are moved in the same direction. However, if both are moved at the same linear speed in the same direction, adding the developer to the latent image on the latent image carrier may not substantially occur. Thus, the linear speed of the developing sleeve is set to be faster than the linear speed of the latent image carrier. In this way, in the developing region, the moving latent image is sequentially supplied with a new developer outrunning the latent image so that a large amount of toner can be supplied to the latent image.

However, in the above configuration, a phenomenon called a trailing blur is likely to occur in which the image density at the trailing end of a toner image becomes deficient. Especially, when a relatively large non-image portion such as a region corresponding to the gap between adjacent sheets is present on the surface of the latent image carrier, while the non-image portion passes through the developing region, a non-developing potential which elastically transfer the toner from the latent image carrier to the developing sleeve is exerted on the developing sleeve for a long period of time. As a result, most toner in the developer carried on the developing sleeve separates from the surface of the carrier particles and moves to the surface of the sleeve (hereinafter, this state will be referred to as a toner separation state). In the toner separation state, such a developer will greatly deteriorates in developing capability as compared to a normal state where most toner is present in the carrier particles. Immediately after the leading end of a latent image disposed adjacent to a relatively large non-image portion in the latent image carrier enters an entrance of the developing region along with the surface movement of the latent image carrier, the developer on the developing sleeve outrunning the leading end of the latent image enters into the toner separation state. Thus, developing defects are likely to occur. However, after that, the leading end of the latent image having moved to the vicinity of an exit of the developing region is supplied with a developer in a normal state in which toner is drawn back to the carrier particles from the surface of the sleeve as the toner passes through a portion facing the central portion of the latent image positioned closer to the rear side than the leading end of the latent image. Therefore, the leading end of the latent image is subjected to an effective developing process in the vicinity of the exit of the developing region. Such developing occurs in a developing region where the first developing sleeve faces the latent image carrier and in a developing region where the second developing sleeve faces the latent image carrier. In contrast, the trailing end of a latent image is not subjected to an effective developing process when the trailing end passes between the vicinity of the entrance of the developing region and the vicinity of the exit thereof. Specifically, immediately after the trailing end of the latent image enters the entrance of the developing region, the trail end of the latent image is supplied with a developer in the toner separation state due to the same reasons as the leading end of the latent image. After that, the trailing end of the latent image having moved to the vicinity of the exit of the developing region is supplied with only a developer which is in the toner separation state because the developer has passed through a region corresponding to a non-image portion disposed on the rear side of the trailing end of the latent image. Thus, the trailing end of the latent image is not subjected to an effective developing process even in the vicinity of the exit. As a result, a trailing blur of a toner image is likely to occur. (Japanese Patent Application Laid-open No. 2000-172064)

Therefore, there is a need for a developing device, an image forming apparatus, and a developing method capable of satisfactorily reproducing narrow-line images, suppressing the occurrence of developing flaws attributable to a developer staying in a developing region for a long period, and suppressing a trailing blur of a toner image.

SUMMARY OF THE INVENTION

It is an object of the present invention to at least partially solve the problems in the conventional technology.

According to an embodiment, there is provided A developing device that includes: a first developer carrier configured to perform a first developing process of developing a latent image on a latent image carrier with a developer containing toner and carrier particles, the developer being carried on a surface of the first developer carrier that is moved in a same direction as a moving direction of the latent image carrier at a faster linear speed than the latent image carrier at a first developing region facing the latent image carrier; a second developer carrier configured to perform a second developing process of further developing a toner image obtained by the first developing process with a developer carried on a surface of the second developer carrier that is moved in a same direction as a moving direction of the image carrier at a faster linear speed than the latent image carrier at a second developing region facing the latent image carrier; and a bias output unit configured to output a developing bias to be applied to the second developer carrier, the developing bias including a direct-current component and a non-rectangular alternating-current component whose waveform has an edge at which a direction of an electric field between the second developer carrier and a background of the latent image carrier is changed to a direction in which the toner is moved from the background toward the second developer carrier, the edge of the waveform having a gradient more gentle than that of a rectangular wave.

According to another embodiment, there is provided an image forming apparatus that includes: the developing device according to the above embodiment, the developing device being configured to develop the latent image carried on the latent image carrier to obtain the toner image; and the latent image carrier configured to carry the latent image.

According to still another embodiment, there is provided a developing method that includes: performing, by a first developer carrier, a first developing process of developing a latent image on a latent image carrier with a developer containing toner and carrier particles, the developer being carried on a surface of the first developer carrier that is moved in a same direction as a moving direction of the latent image carrier at a faster linear speed than the latent image carrier at a first developing region facing the latent image carrier; performing, by a second developer carrier, a second developing process of further developing a toner image obtained by the first developing process with a developer carried on a surface of the second developer carrier that is moved in a same direction as a moving direction of the image carrier at a faster linear speed than the latent image carrier at a second developing region facing the latent image carrier; and a bias output unit configured to output a developing bias to be applied to the second developer carrier, the developing bias including a direct-current component and a non-rectangular alternating-current component whose waveform has an edge at which a direction of an electric field between the second developer carrier and a background of the latent image carrier is changed to a direction in which the toner is moved from the background toward the second developer carrier, the edge of the waveform having a gradient more gentle than that of a rectangular wave.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, electrophotographic printers (hereinafter, referred to simply as printers) as exemplary embodiments will be described as image forming apparatuses to which the invention is applied.

Figure 1:
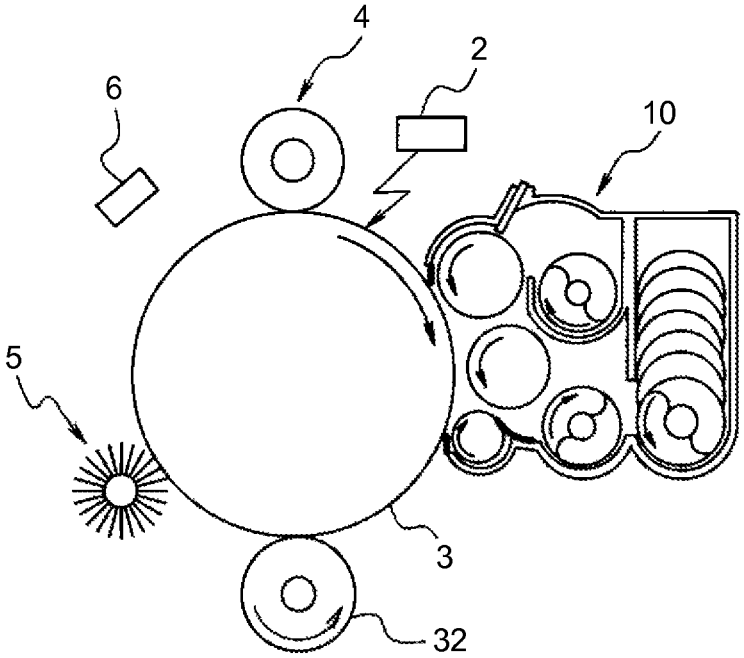
FIG. 1 is a configuration diagram illustrating a main part of a printer according to an exemplary embodiment of the invention.

First, a basic configuration of a printer according to an exemplary embodiment will be described. FIG. 1 is a configuration diagram illustrating a relevant part of the printer according to the exemplary embodiment. This printer includes an optical writing device 2, a photosensitive element 3, a charging unit 4, a drum cleaning device 5, a neutralization lamp 6, a developing device 10, a primary transfer roller 32, and the like.

The photosensitive element 3 as a latent image carrier has a drum shape and is formed by a pipe of aluminum or the like and a photosensitive layer of an organic photosensitive material coated on the aluminum pipe. An endless belt-shaped photosensitive element may be used.

The photosensitive element 3 is rotated in a clockwise direction in the drawing by a driving unit (not illustrated), and the charging unit 4 charges the circumferential surface thereof uniformly with the same polarity as a normal charging polarity of toner. In the printer according to the exemplary embodiment, one in which a charging roller to which a charging bias is applied rotates in contact with the photosensitive element 3 is used as the charging unit 4. A scorotron charger or the like that performs a charging process on the photosensitive element 3 in a non-contact manner may be used in place of the charging unit 4 having such a configuration.

The circumferential surface of the photosensitive element 3 which is uniformly charged in this manner carries an electrostatic latent image by being subjected to optical scanning with a writing density of 600 [dpi] by the optical writing device 2. The optical writing device 2 is configured to optically scan the surface of the photosensitive element 3 with light emitted from individual LEDs of an LED array. An optical writing device configured to optically scan the surface of the photosensitive element 3 with a laser beam emitted from a laser diode so that the laser beam strikes the photosensitive element 3 while being deflected in the main-scanning direction (drum axis direction) by a polygon mirror may also be used.

The electrostatic latent image formed on the surface of the photosensitive element 3 is developed by the developing device 10 to become a toner image. The toner image enters a primary transfer nip which is formed by the contact between the photosensitive element 3 and the primary transfer roller 32 with rotation of the photosensitive element 3. In the primary transfer nip, a transfer electric field that electrostatically moves toner from the photosensitive element 3 to the primary transfer roller 32 is formed between the electrostatic latent image having a potential of the same polarity as the normal transfer polarity of the toner and the primary transfer roller 32 to which a primary transfer bias of a polarity opposite to the normal transfer polarity of the toner is applied.

The printer according to the exemplary embodiment also includes a paper cassette, a pair of registration rollers, a fixing device, and the like, which are not illustrated. A recording sheet fed from the paper cassette storing recording sheets as recording members is inserted into a registration nip which is formed by the contact between the two rollers as the pair of registration rollers. The pair of registration rollers temporarily stops their rotation when the recording sheet is inserted into the registration nip. The two rollers start rotating again at the timing when the recording sheet is synchronized with the toner image on the photosensitive element 3, so that the recording sheet is conveyed to the primary transfer nip. In the primary transfer nip, the toner image on the photosensitive element 3 is primarily transferred to the recording sheet by the action of the transfer electric field described above and the nipping pressure.

The recording sheet having passed through the primary transfer nip is conveyed to the fixing device (not illustrated). The recording sheet is heated and pressurized in the fixing device, so that the toner image is fixed to the surface of the recording sheet. Moreover, a residual transfer toner which was not primarily transferred to the recording sheet is attached to the surface of the photosensitive element 3 having passed through the primary transfer nip. The residual transfer toner is removed from the surface of the photosensitive element 3 by the drum cleaning device 5. In the printer according to the exemplary embodiment, the drum cleaning device 5 has a configuration in which the residual transfer toner is scraped off the surface of the photosensitive element 3 by a cleaning brush roller which is configured to rotate. In place of such a type, a configuration which uses a cleaning blade may be adopted.

The surface of the photosensitive element 3 in which the residual transfer toner is cleaned is neutralized by the neutralization lamp 6 so as to be prepared for the next image formation.

Figure 2:
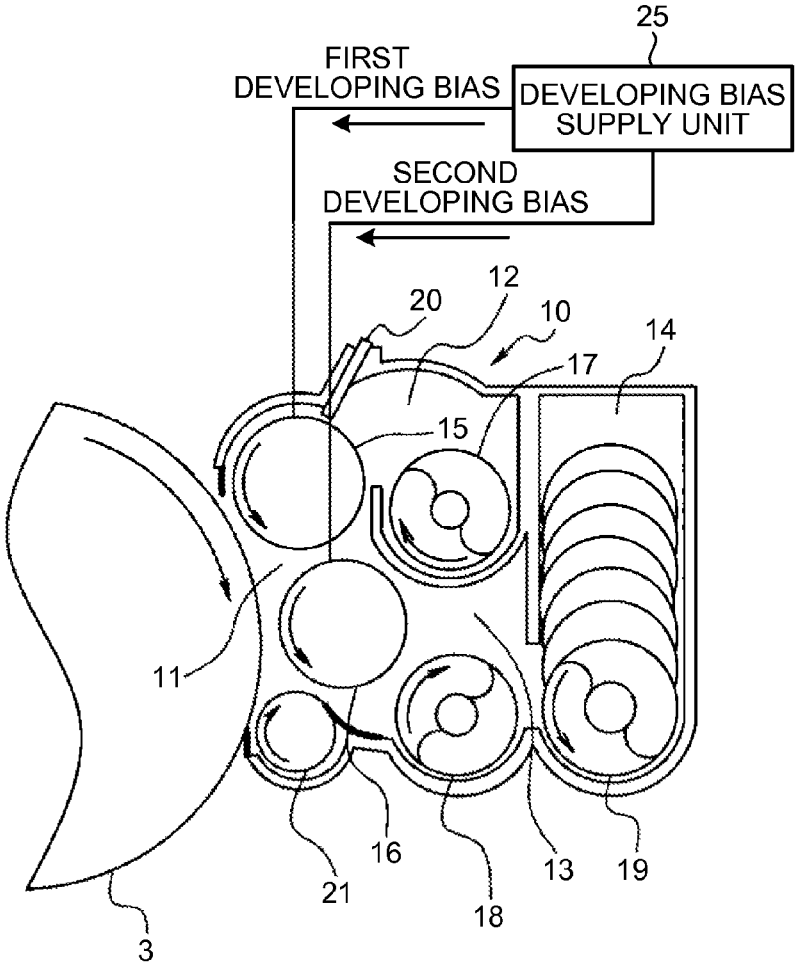
FIG. 2 is an enlarged configuration diagram illustrating a developing device of the printer together with a part of a photosensitive element.
Figure 3:
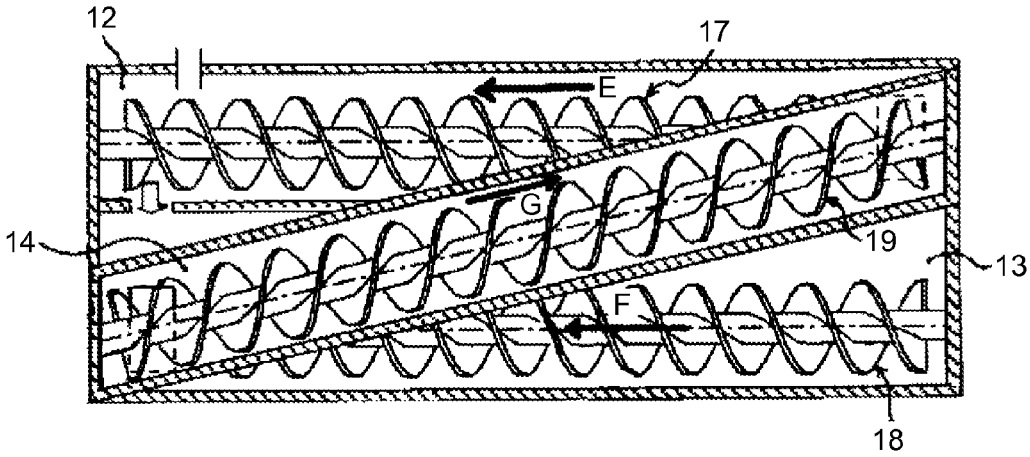
FIG. 3 is a longitudinal sectional view illustrating a developer supplying unit, a developer recovering unit, and a developer returning unit in the developing device.

FIG. 2 is an enlarged configuration diagram illustrating the developing device 10 together with a part of the photosensitive element 3. Moreover, FIG. 3 is a longitudinal sectional view illustrating a developer supplying unit 12, a developer recovering unit 13, and a developer returning unit 14 in the developing device 10. The behavior of the developing device 10 will be described in detail with reference to these drawings. A drum-shaped photosensitive element 3Y is arranged in an attitude such that the axial direction thereof extends in a direction (horizontal direction) orthogonal to the drawing sheet. The developing device 10 includes a developing unit 11, the developer supplying unit 12, the developer recovering unit 13, and the developer returning unit 14. Developer containing toner and magnetic carrier particles (not illustrated) is stored in each of these units. Moreover, a first developing sleeve 15 which is a first developer carrier and a second developing sleeve 16 which is a second developer carrier are rotatably accommodated in the developing unit 11 so as to be aligned in a vertical direction. Furthermore, a supplying conveyance screw 17 is rotatably accommodated in the developer supplying unit 12. Furthermore, a receiving conveyance screw 18 is rotatably accommodated in the developer recovering unit 13. Furthermore, an inclination conveyance screw 19 is rotatably accommodated in the developer returning unit 14.

The first developing sleeve 15 and the second developing sleeve 16 arranged therebelow are formed of a non-magnetic pipe that is rotated by a driving unit which is formed by a motor (not illustrated), a drive transmission system, and the like. Examples of a material of the non-magnetic pipe include aluminum, brass, stainless, a conductive resin, or the like.

The developing unit 11 accommodating the first and second developing sleeves 15 and 16 includes an opening which is formed in a wall on a side facing the photosensitive element 3, and a part of the circumferential surface of each of the two developing sleeves is exposed from the opening. A region of the developing unit 11 on the side opposite to the side facing the photosensitive element 3 communicates with the developer supplying unit 12 and the developer recovering unit 13 over the entire region in the axial direction of the two developing sleeves. The developer supplying unit 12 is arranged right above the developer recovering unit 13 in the vertical direction. The regions (the regions close to the photosensitive element) on the left side in the drawing, of the developer supplying unit 12 and the developer recovering unit 13 communicate with the developing unit 11 over the entire region in the longitudinal direction of the developer supplying unit 12 and the developer recovering unit 13.

A first magnet roller (not illustrated) is non-rotatably accommodated in the first developing sleeve 15. The first magnet roller includes a pumping magnetic pole configured to draw the developer in the developer supplying unit 12 onto the surface of the first developing sleeve 15 to be pumped up to the first developing sleeve 15, a doctor facing magnetic pole located at a position facing a doctor blade 20, a main magnetic pole located at a position facing the photosensitive element 3, a conveying magnetic pole configured to convey the developer on the first developing sleeve 15 toward the second developing sleeve 16, and the like.

A second magnet roller (not illustrated) is non-rotatably accommodated in the second developing sleeve 16. The second magnet roller includes a receiving magnetic pole configured so that the developer conveyed by the first developing sleeve 15 is received on the second developing sleeve 16, a main magnetic pole located at a position facing the photosensitive element 3, a receiving roller facing magnetic pole located at a position facing a carrier-particle receiving roller 21, a developer separating magnetic pole (developer separating pole) configured so that the developer on the second developing sleeve 16 is separated toward the developer recovering unit 13, and the like.

The supplying conveyance screw 17 accommodated in the developer supplying unit 12 takes an attitude such that it extends in the horizontal direction similarly to the photosensitive element 3 and the two developing sleeves. The supplying conveyance screw 17 is rotated by a driving unit to thereby convey the developer in the developer supplying unit 12 in the horizontal direction.

The receiving conveyance screw 18 accommodated in the developer recovering unit 13 also takes an attitude such that it extends in the horizontal direction similarly to the photosensitive element 3 and the two developing sleeves. The receiving conveyance screw 18 is rotated by a driving unit (not illustrated) to thereby convey the developer in the developer recovering unit 13 in the horizontal direction.

The developer returning unit 14 is adjacent to the developer supplying unit 12 and the developer recovering unit 13 on the side opposite to the developing unit 11. The developer returning unit 14 is formed so as to extend in an attitude tilted from the horizontal direction unlike the other units. The inclination conveyance screw 19 is accommodated in the developer returning unit 14 in a tilted state. Most part of the developer returning unit 14 is partitioned from the developer supplying unit 12 and the developer recovering unit 13 by a partition wall. However, the developer returning unit 14 partially communicates with the developer supplying unit 12 and the developer recovering unit 13 by an opening formed in the partition wall.

In the developer supplying unit 12, with rotation of the supplying conveyance screw 17, developer (not illustrated) held in the blades of the supplying conveyance screw 17 is conveyed from the rear side in the direction orthogonal to the drawing sheet in FIG. 2 toward the front side (a direction indicated by arrow E in FIG. 3). In the course of the conveyance, the developer is sequentially supplied to the first developing sleeve 15 in the developing unit 11. The developer is pumped up to the first developing sleeve 15 by magnetic force exerted by the pumping magnetic pole of the first magnet roller.

The thickness of the developer pumped up to the first developing sleeve 15 is regulated by the doctor blade 20 that faces the surface of the first developing sleeve 15 with a predetermined gap therebetween. The developer is conveyed up to a first developing region facing the photosensitive element 3, and there, the developer contributes to developing.

The developer which is not pumped up to the first developing sleeve 15 but is conveyed up to the vicinity of an end (a front end in FIG. 2) of the supplying conveyance screw 17 on the downstream side in the developer conveying direction is dropped into the developer recovering unit 13 through a dropping opening (not illustrated) formed in the bottom wall of the developer supplying unit 12.

The developer which has been conveyed up to the first developing region where the first developing sleeve 15 faces the photosensitive element 3 with rotation of the first developing sleeve 15 and contributed to developing passes through the first developing region with rotation of the first developing sleeve 15. The developer is transferred to the second developing sleeve 16 arranged below the first developing sleeve 15. After that, the developer is conveyed to a second developing region where the second developing sleeve 16 faces the photosensitive element 3 with rotation of the second developing sleeve 16, and there, the developer contributes to developing again. The developer having finished the second developing step is conveyed up to a communication position between the developing unit 11 and the developer recovering unit 13. The developer is separated from the surface of the second developing sleeve 16 by the effect of a repulsive magnetic field formed by the developer separating magnetic pole of the second magnet roller. The developer separated from the surface of the second developing sleeve 16 is dropped into the developer recovering unit 13.

The developer which has passed through the second developing region with rotation of the second developing sleeve 16 and separated from the surface of the second developing sleeve 16 at a position relatively distant from the developer recovering unit 13 is conveyed toward the developer recovering unit 13 by the rotating force of the carrier-particle receiving roller 21 arranged right below the second developing sleeve 16.

In the developer recovering unit 13, developer (not illustrated) held in the blades of the receiving conveyance screw 18 is conveyed from a rear side in a direction orthogonal to the drawing sheet in FIG. 2 toward the front side (a direction indicated by arrow F in FIG. 3) with rotation of the receiving conveyance screw 18. In the course of the conveyance, toner is supplied by a toner supplying device (not illustrated). Moreover, the developer dropped from the dropping opening of the developer supplying unit 12 is received in the developer recovering unit 13. After that, the developer which has been conveyed up to the vicinity of an end (a front end in FIG. 2) of the receiving conveyance screw 18 on the downstream side in the developer conveying direction enters into the developer returning unit 14 through the opening formed in the partition wall.

The developer which has entered into the developer returning unit 14 is received on the end of the inclination conveyance screw 19 on the upstream side in the developer conveying direction. Then, the developer is conveyed with an upward gradient as indicated by arrow G in FIG. 3 with rotation of the inclination conveyance screw 19 which is arranged in an obliquely upward attitude from the upstream side in the developer conveying direction to the downstream side in the developer conveying direction. When the developer is conveyed up to the vicinity of the end of the inclination conveyance screw 19 on the downstream side in the developer conveying direction, the developer is returned into the developer supplying unit 12 through a conveyance opening formed on the partition wall. After that, the developer is received on the end of the supplying conveyance screw 17 on the upstream side in the developer conveying direction.

As illustrated in FIG. 2, a developing bias supply unit 25 of the developing device 10 outputs a first developing bias to be applied to the first developing sleeve 15 and a second developing bias to be applied to the second developing sleeve 16.

Hereinafter, the printer according to the exemplary embodiment is described with reference to specific examples of various potential conditions. However, these potential conditions are examples only.

Referring to FIG. 1, the surface of the photosensitive element 3 is uniformly charged to −330 [V] by the charging unit 4. The voltage of a portion (electrostatic latent image) of the surface of the photosensitive element 3, in which optical writing is performed by the optical writing device 2, is decreased to −100 [V].

Figure 4:
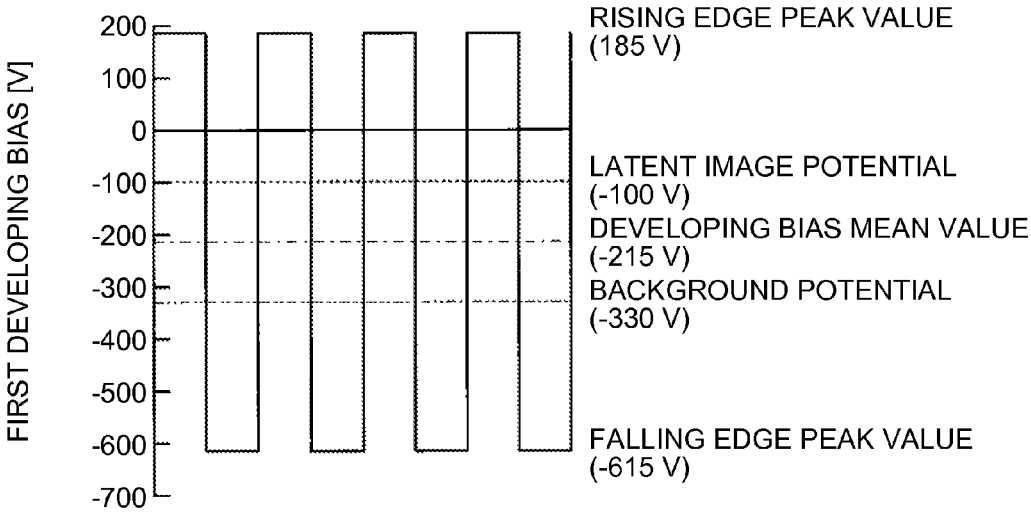
FIG. 4 is a graph illustrating a change over time of a first developing bias applied to a first developing sleeve of the developing device.

FIG. 4 is a graph illustrating a change over time of the first developing bias applied to the first developing sleeve 15. The first developing bias has a direct-current voltage (direct-current component) of −215 [V] on which an alternating-current voltage (alternating-current component) formed by a rectangular wave having a peak-to-peak value Vpp=800 [V], a frequency f=9 [kHz], and duty=50 [%] is superimposed. In the first developing bias, the rising edge peak value is 185 [V], the falling edge peak value is −615 [V], and the mean value is −215 [V].

As described above, in this printer, the potential (hereinafter referred to as a latent image potential) of the electrostatic latent image formed on the photosensitive element 3 is −100 [V]. Moreover, the uniformly charged potential (hereinafter referred to as a background potential) of the photosensitive element 3 is −330 [V]. Under these conditions, when the first developing bias having the mean value of −215 [V] is applied to the first developing sleeve 15, between the electrostatic latent image of the photosensitive element 3 and the first developing sleeve 15, the toner charged with a negative polarity is relatively moved from the sleeve surface having the potential of −215 [V] to the latent image having the potential of −100 [V]. As a result, the toner is attached to the electrostatic latent image to form a toner image. On the other hand, between the background portion of the photosensitive element 3 and the first developing sleeve 15, the toner charged with the negative polarity is relatively moved from the background portion having the potential of −330 [V] to the sleeve surface having the potential of −215 [V]. As a result, the toner is prevented from being attached to the background portion of the photosensitive element 3.

The behavior of the toner between the electrostatic latent image of the photosensitive element 3 and the first developing sleeve 15 will be described in further detail. In the graph of FIG. 4, at the occurrence timings of falling edges where the potential of 185 [V] immediately falls to the potential of −615 [V], the toner which has been attached to the magnetic carrier particles of the developer on the first developing sleeve 15 is moved from the sleeve surface to the latent image and transferred to the electrostatic latent image of the photosensitive element 3. In contrast, at the occurrence timings of rising edges where the potential of −615 [V] immediately rises to the potential of 185 [V], the toner which has been attached to the electrostatic latent image of the photosensitive element 3 is moved from the latent image to the sleeve surface and attached to the magnetic carrier particles of the developer on the first developing sleeve 15. In this manner, in the first developing region where the first developing sleeve 15 faces the photosensitive element 3, the toner repeatedly reciprocated between the first developing sleeve 15 and the electrostatic latent image of the photosensitive element 3. However, the mean value of the surface potential of the first developing sleeve 15 is about −215 [V] that is approximately the same as the mean value of the first developing bias and is greater on the negative side than −100 [V] which is the potential of the electrostatic latent image, the toner is relatively moved from the sleeve to the latent image while reciprocating.

In a conventional image forming apparatus, the same developing bias as the first developing bias was used as the second developing bias applied to the second developing sleeve 16. Thus, it is difficult to satisfactorily develop the trailing end of an electrostatic latent image continuous to a relatively large non-image portion on the surface of the photosensitive element 3. As a result, a trailing blur of a toner image occurred. This is based on the following reasons. As described above, in the second developing region where the second developing sleeve 16 faces the photosensitive element 3, the trailing end of the electrostatic latent image is supplied with the developer in the toner separation state when the trailing end passes between the vicinity of the entrance of the second developing region and the vicinity of the exit thereof.

Figure 5:
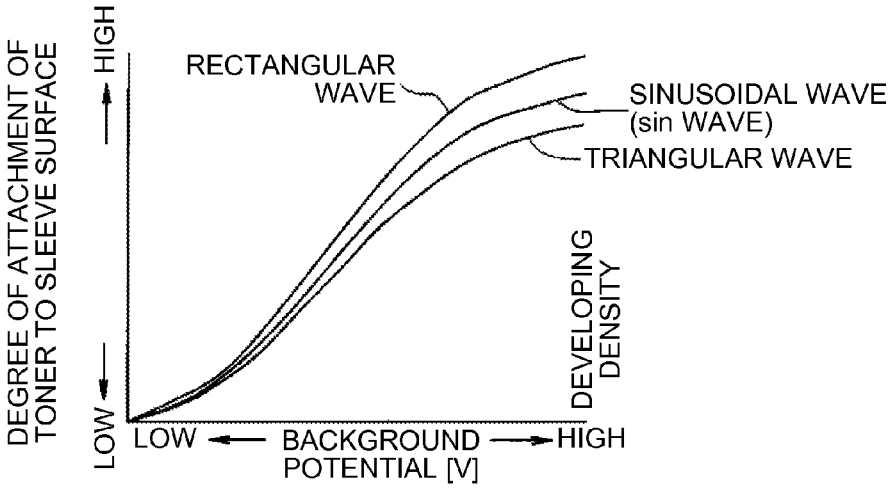
FIG. 5 is a graph illustrating the relation between the degree of attachment of toner to the surface of a developing sleeve having passed through a position facing a background of the photosensitive element, a background potential, and the waveform of an alternating-current component of a developing bias.

FIG. 5 is a graph illustrating the relation between the degree of attachment of toner to the surface of a developing sleeve having passed through a position facing the background portion of the photosensitive element 3, a background potential, and the waveform of an alternating-current component of a developing bias. The developer on a developing sleeve having passed through a region facing a relative large non-image portion (background portion) of the photosensitive element 3 is in the toner separation state in which a large amount of toner is separated from the surface of the magnetic carrier particles by the effect of a background potential and attached to the surface of the developing sleeve. The background potential is a potential difference between the mean value of the developing bias and the background potential. The effect of causing toner to be attached to the surface of the developing sleeve increases as the value of the background potential increases. That is, as the background potential increases, the degree of attachment of toner to the sleeve surface increases. If developing biases include direct-current voltages of the same value and alternating-current voltages having the same peak-to-peak value Vpp, frequency f, and duty, the degree of attachment of toner to the sleeve surface gradually decreases in order of a rectangular alternating-current voltage, a sinusoidal (sine-wave) alternating-current voltage, and a triangular alternating-current voltage.

The reasons why the degree of attachment of toner to the sleeve surface decreases gradually will be described below.

Figure 6:
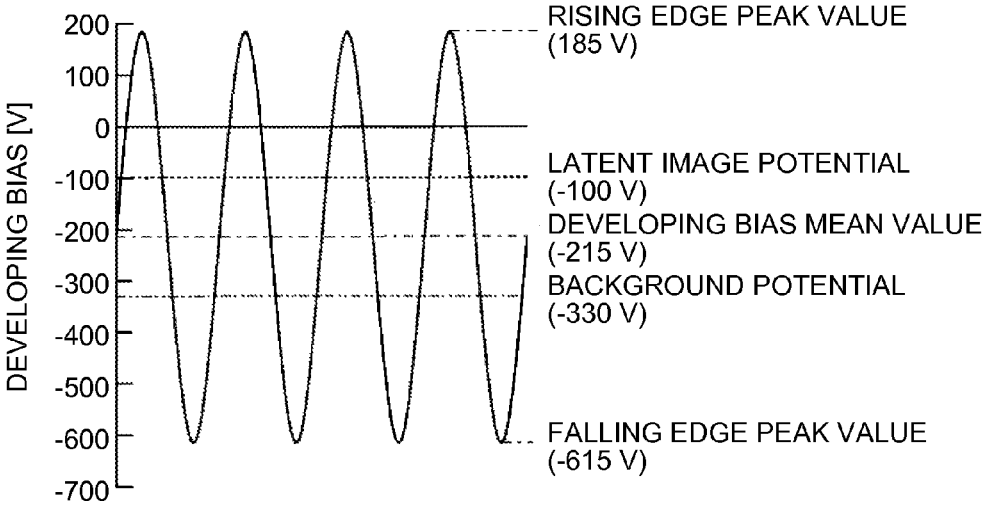
FIG. 6 is a graph illustrating a change over time of a developing bias including an alternating-current voltage formed by a sinusoidal wave.
Figure 7:
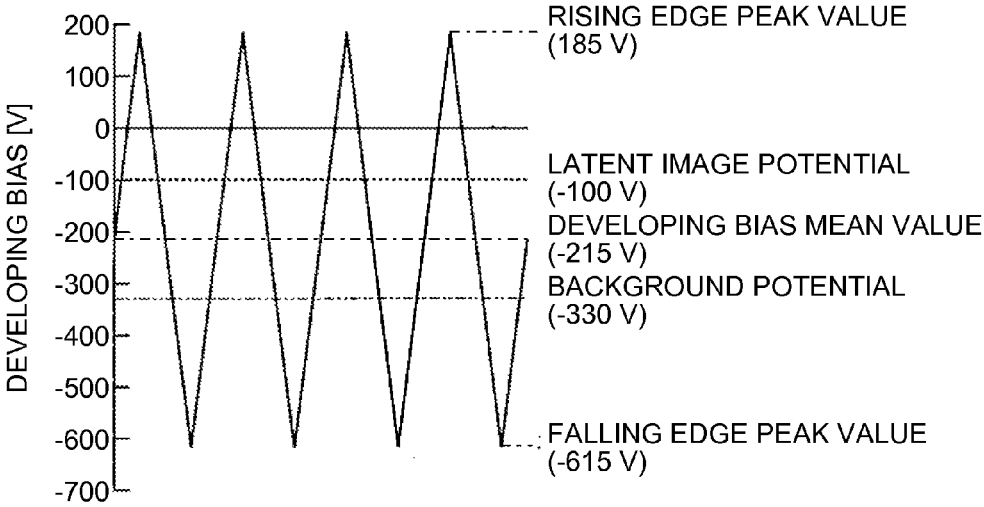
FIG. 7 is a graph illustrating a change over time of a developing bias including an alternating-current voltage formed by a triangular wave.
Figure 8:
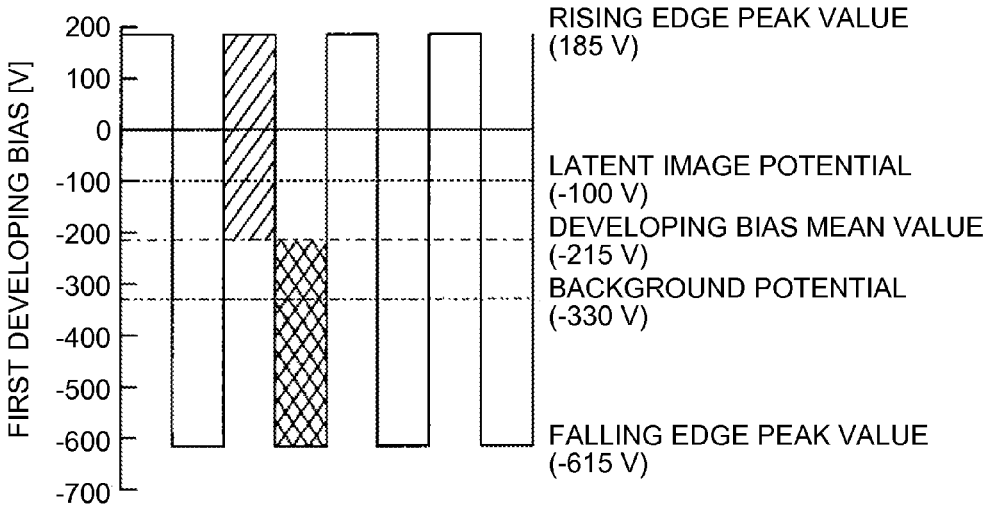
FIG. 8 is a graph for describing the duty of a waveform.

FIG. 6 is a graph illustrating a change over time of a developing bias including an alternating-current voltage formed by a sinusoidal wave. Moreover, FIG. 7 is a graph illustrating a change over time of a developing bias including an alternating-current voltage formed by a triangular wave. The developing biases illustrated in FIGS. 6 and 7 have the same direct-current voltage and the same peak-to-peak value Vpp (800 V), frequency f (9 kHz), and duty (50%) of an alternating-current voltage as the first developing bias illustrated in FIG. 4. That is, only the waveform of the alternating-current voltage is different from the first developing bias. Here, "duty" is the ratio of the area of a developer peak portion to the total area of one cycle of a waveform. The total area of one cycle of a waveform is the sum of the area of a mountain portion on the upper side than the peak-to-peak center of one cycle and the area of a valley portion on the lower side than the peak-to-peak center. The developing peak portion is the area in which toner is moved from the developing sleeve to the latent image, among the areas of the mountain and valley portions. For example, in the case of the first developing bias illustrated in FIG. 4, a hatched portion is the total area of one cycle of the waveform as illustrated in FIG. 8. Among the mountain and valley portions of the waveform, a portion in which toner of the negative polarity is moved from the developing sleeve to the latent image is the valley portion. Therefore, the area of the developing peak portion is the area of the valley portion as indicated by a cross-hatched portion in the drawing.

In the first developing bias illustrated in FIG. 4, when the potential is closer to the positive polarity side than the background potential (−330 V), the direction of an electric field between the first developing sleeve 15 and the background portion (non-image portion) of the photosensitive element 3 is oriented toward the sleeve. Moreover, when the potential is closer to the negative polarity side than the background potential (−330 V), the direction of an electric field between the first developing sleeve 15 and the background portion is oriented toward the background portion. The sleeve direction is a direction in which toner is moved from the background portion toward the developing sleeve. Moreover, the background portion direction is a direction in which toner is moved from the developing sleeve toward the background portion. In the first developing bias illustrated in FIG. 4, the rising edges of the waveform rise immediately approximately perpendicularly. This implies that at the occurrence timings of the rising edges, the electric field state is immediately changed from its maximum intensity in the background portion direction to its maximum intensity in the sleeve direction. When such a changing method is employed, the toner which has been attached to the electrostatic latent image of the photosensitive element 3 and the background portion is immediately returned to the developing sleeve. On the other hand, in a developing bias including an alternating-current voltage formed by a sinusoidal wave illustrated in FIG. 6, the rising edges of the waveform rise more gradually than the perpendicular (the edge of a rectangular waveform). This implies that the electric field state is changed from its maximum intensity in the background portion direction to its maximum intensity in the sleeve direction over a longer period than the rectangular wave. When the electric field state is changed over a longer period in such a manner, the degree of attachment of toner to the surface of the developing sleeve having passed through the position facing the background portion of the photosensitive element 3 becomes lower than that of the rectangular wave. Moreover, in a developing bias including an alternating-current voltage formed by a triangular wave illustrated in FIG. 7, the rising edges of the waveform rise more gradually than the sinusoidal wave. This implies that the electric field state is changed from its maximum intensity in the background portion direction to its maximum intensity in the sleeve direction over a longer period than the sinusoidal wave. Thus, the degree of attachment of toner to the surface of the developing sleeve having passed through the position facing the background portion of the photosensitive element 3 becomes lower than that of the sinusoidal wave.

As described above, in place of a rectangular alternating-current component, by using a non-rectangular alternating-current component in which one of the rising and fall edges of the waveform at which the direction of an electric field between the second developing sleeve 16 and the background portion of the photosensitive element 3 is changed from the background portion direction to the sleeve direction has a more gradual gradient than the perpendicular as the alternating-current component of the second developing bias, the degree of attachment of toner to the surface of the developing sleeve having passed through the position facing the background portion of the photosensitive element 3 can be lowered than the case of using a rectangular alternating-current component.

Therefore, in the printer according to the exemplary embodiment, the developing bias supply unit 25 as a bias output unit is configured to output a non-rectangular alternating-current component in which the direction of an electric field between the second developing sleeve 16 and the background portion of the photosensitive element 3 is changed from the background portion direction to the sleeve direction has a more gradual gradient than the perpendicular in place of the rectangular alternating-current component of the second developing bias. In such a configuration, the degree of attachment of toner to the surface of the second developing sleeve 16 having passed through the position facing the background portion of the photosensitive element 3 can be lowered than the case where a rectangular alternating-current component is output as in the case of the related art thereby suppressing a trailing blur of a toner image.

The developing bias supply unit 25 is configured to output an alternating-current component having the same peak-to-peak value Vpp as the alternating-current component of the first developing bias as the alternating-current component of the second developing bias. This is based on the reasons described below. That is, even when a rectangular alternating-current voltage similarly to the first developing bias is used as the alternating-current voltage of the second developing bias, if the peak-to-peak value Vpp is lower than that of the alternating-current voltage of the first developing bias, a trailing blur of a toner image can be suppressed to some extent. When the peak-to-peak value Vpp is decreased, the intensity of the electric field is further decreased when the direction of the electric field is changed from the background portion direction to the sleeve direction, the degree of attachment of toner to the surface of the second developing sleeve 16 having passed through the position facing the background portion of the photosensitive element 3 can be further lowered. However, if the peak-to-peak value Vpp of the alternating-current voltage is decreased, the intensity of an electric field that causes toner to be transferred to the edge of a character or a narrow line becomes deficient, the edge of the character or the narrow line is likely to disappear. Thus, the peak-to-peak value Vpp of the alternating-current voltage of the second developing bias is set to be the same as the first developing bias. By doing so, toner can be made satisfactorily attached to the edge of a character and a narrow line and the occurrence of the disappearance of the edge of the character and the narrow line may be suppressed.

Figure 9:
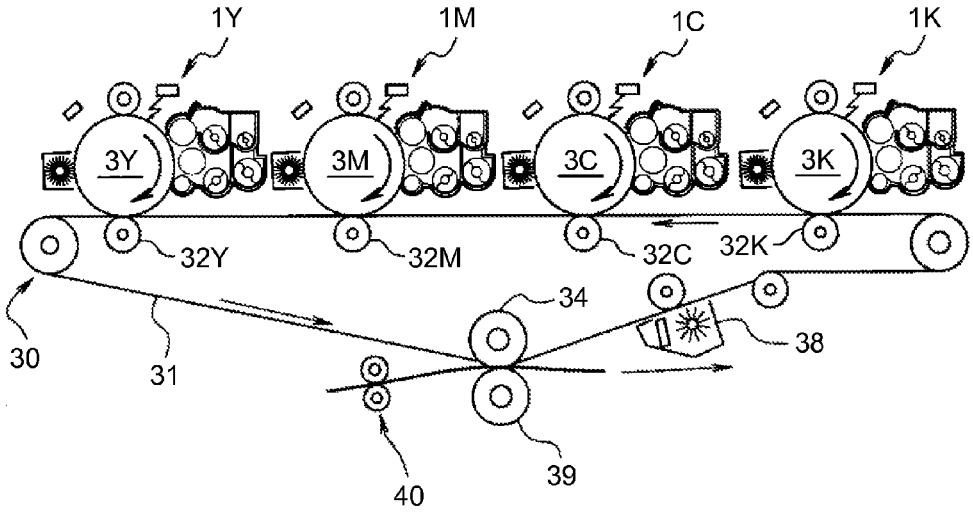
FIG. 9 is a configuration diagram illustrating a main part of a printer according to a first modified example.

FIG. 9 is a configuration diagram illustrating a main part of a printer according to a first modified example in which a part of the configuration of the printer according to the exemplary embodiment is modified. The printer according to the first modified example includes four process units 1Y, 1M, 1C, and 1K for the colors of yellow (Y), magenta (M), cyan (C), and black (K). The configuration of the K process unit 1K is approximately the same as that of a combination of the optical writing device 2, the photosensitive element 3, the charging unit 4, the drum cleaning device 5, the neutralization lamp 6, and the developing device 10 of the printer according to the exemplary embodiment. The combination is supported by a common supporting body and integrally attached to and detached from the main body of the printer. The Y, M, and C process units 1Y, 1M, and 1C have the same configuration as the K process unit 1K except that the colors of the toner used therein are different.

Y, M, C, and K toner images are formed on the photosensitive elements 3Y, 3M, 3C, and 3K of the process units 1Y, 1M, 1C, and 1K, respectively. A transfer unit 30 is arranged below the four process units 1Y, 1M, 1C, and 1K. The transfer unit 30 forms Y, M, C, and K primary transfer nips by bringing an intermediate transfer belt 31 which has no end portion in the moving direction and moves in the counter-clockwise direction in the drawing while being stretched by a plurality of rollers into contact with the photosensitive elements 3Y, 3M, 3C, and 3K. In the vicinity of the Y, M, C, and K primary transfer nips, primary transfer rollers 32Y, 32M, 32C, and 32K arranged inside the belt loop press the intermediate transfer belt 31 toward the photosensitive elements 3Y, 3M, 3C, and 3K. A primary transfer bias is applied to these primary transfer rollers 32Y, 32M, 32C, and 32K by a power supply (not illustrated). In this way, a primary transfer electric field that electrostatically moves the toner images on the photosensitive elements 3Y, 3M, 3C, and 3K toward the intermediate transfer belt 31 is formed in the Y, M, C, and K primary transfer nips. The toner images are primarily transferred by being superimposed on each other at the Y, M, C, and K primary transfer nips on the front surface of the intermediate transfer belt 31 sequentially passing through the primary transfer nips with the movement in the counter-clockwise direction in the drawing. By primary transfer superimposing the images, four colors of superimposed toner images (hereinafter referred to as four-color toner images) are formed on the front surface of the intermediate transfer belt 31.

A secondary transfer roller 39 is arranged below the intermediate transfer belt 31 so that the intermediate transfer belt 31 is disposed between the secondary transfer roller 39 and a secondary transfer opposing roller 34 in the belt loop. In this way, a secondary transfer nip where the front surface of the intermediate transfer belt 31 makes contact with the secondary transfer roller 39 is formed. A secondary transfer bias is applied to the secondary transfer roller 39 by a power supply (not illustrated). On the other hand, the secondary transfer opposing roller 34 in the belt loop is grounded. In this way, a secondary transfer electric field is formed in the secondary transfer nip.

A pair of registration rollers 40 is arranged on the left side of the secondary transfer nip in the drawing. Moreover, a registration sensor (not illustrated) is arranged in the vicinity of the entrance of the registration nip of the pair of registration rollers 40. A recording sheet P is conveyed toward the pair of registration rollers 40 from a sheet supplying device (not illustrated). The conveyance of the recording sheet is temporarily stopped after elapse of a predetermined period when the leading end thereof is detected by the registration sensor, and the leading end thereof is caused to come into contact with the registration nip of the pair of registration rollers 40. As a result, the attitude of the recording sheet P is corrected to be prepared for synchronization with image formation.

When the leading end of the recording sheet P comes into contact with the registration nip, the pair of registration rollers 40 rotates again at the timing at which the recording sheet P is synchronized with the four-color toner images on the intermediate transfer belt 31 to thereby convey the recording sheet P to the secondary transfer nip. In the secondary transfer nip, the four-color toner images on the intermediate transfer belt 31 are collectively secondarily transferred by the effect of the secondary transfer electric field and the nipping pressure, whereby a full-color image is obtained together with the white color of the recording sheet. The recording sheet P having passed through the secondary transfer nip is separated from the intermediate transfer belt 31 and conveyed to a fixing device (not illustrated).

A residual transfer toner which has not been transferred to the recording sheet P at the secondary transfer nip is attached to the surface of the intermediate transfer belt 31 having passed through the secondary transfer nip. The residual transfer toner is scraped and removed by a belt cleaning device 38 that makes contact with the intermediate transfer belt 31.

Figure 10:
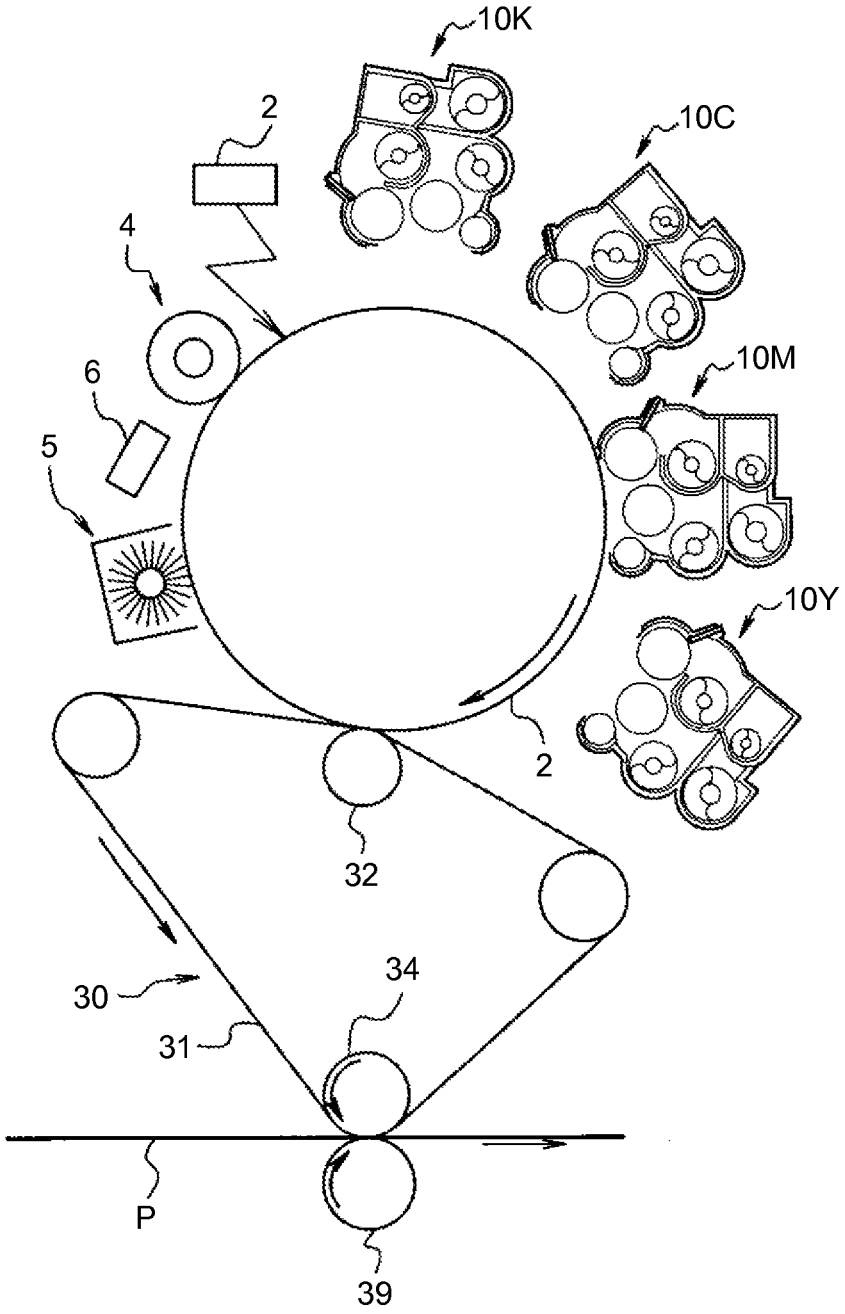
FIG. 10 is a configuration diagram illustrating a main part of a printer according to a second modified example.

FIG. 10 is a configuration diagram illustrating a main part of a printer according to a second modified example in which a part of the configuration of the printer according to the exemplary embodiment is modified. The printer according to the second modified example includes Y, M, C, and K developing devices 10Y, 10M, 10C, and 10K around the photosensitive element 3. The configuration of the K developing device 10K is the same as that of the developing device 10 of the printer according to the exemplary embodiment. Moreover, the Y, M, and C developing devices 10Y, 10M, and 10C have the same configuration as the K developing device 10K except that the colors of the toner used therein are different. The Y, M, C, and K developing devices 10Y, 10M, 10C, and 10K are moved by a moving unit (not illustrated) so as to independently move closer to and away from the photosensitive element 3. Only a developing device that performs a developing process among these developing devices 10Y, 10M, 10C, and 10K is moved to a position approaching the photosensitive element 3 to thereby contribute to developing. For example, when a latent image on the photosensitive element 3 is developed with K toner, only the K developing device 10K is moved to a position approaching the photosensitive element 3, and the Y, M, and C developing devices 10Y, 10M, and 10C perform standby at a position far away from the photosensitive element 3.

The transfer unit 30 that forms a primary transfer nip by bringing the intermediate transfer belt 31 moving in the counter-clockwise direction in the drawing into contact with the photosensitive element 3 is arranged below the photosensitive element 3. In this printer, when forming a color image, first, during one rotation of the intermediate transfer belt 31, a Y latent image is formed on the photosensitive element 3 and developed by the Y developing device 10Y. The obtained Y toner image is primarily transferred to the intermediate transfer belt 31 at the primary transfer nip. Subsequently, during the second rotation of the intermediate transfer belt 31, an M latent image is formed on the photosensitive element 3 and developed by the M developing device 10M. The obtained M toner image is primarily transferred by being superimposed on the Y toner image on the intermediate transfer belt 31 at the primary transfer nip. Similarly, the C and K toner images formed on the photosensitive element 3 during the third and fourth rotation of the intermediate transfer belt 31 are primarily transferred by being superimposed on the Y and M toner images on the intermediate transfer belt 31. When four-color toner images are formed on the intermediate transfer belt 31 in this way, the secondary transfer roller 39 which has been separated from the intermediate transfer belt 31 comes into contact with the intermediate transfer belt 31 to thereby form a secondary transfer nip. Moreover, a belt cleaning device (not illustrated in FIG. 10) which has been separated from the intermediate transfer belt 31 comes into contact with the intermediate transfer belt 31 to thereby form a cleaning nip.

After that, the four-color toner images on the intermediate transfer belt 31 are collectively secondarily transferred to the recording sheet P at the secondary transfer nip, and a residual transfer toner which has been attached to the front surface of the intermediate transfer belt 31 having passed through the secondary transfer nip is removed by the belt cleaning device. The recording sheet P having passed through the secondary transfer nip is separated from the intermediate transfer belt 31 and conveyed to a fixing device (not illustrated).

Next, a printer of respective embodiments in which a more characteristic configuration is added to the printer according to the exemplary embodiment will be described. In the following description, unless particularly described, the configuration of the printer according to the respective embodiments is the same as that of the exemplary embodiment.

First Embodiment

In a printer according to a first embodiment, first, the developing bias supply unit 25 is configured to output the same developing bias as the developing bias illustrated in FIG. 6 as the second developing bias. The second developing bias includes a sinusoidal wave as an alternating-current voltage. A power supply circuit that outputs a sinusoidal alternating-current voltage is available on the market as is widely known. Thus, a circuit that outputs the second developing bias can be configured using a general power supply circuit.

Second Embodiment

In a printer according to a second embodiment, first, the developing bias supply unit 25 is configured to output the same developing bias as the developing bias illustrated in FIG. 7 as the second developing bias. The second developing bias has the same conditions as the first developing bias (see FIG. 4) except that the alternating-current voltage includes triangular waves. The degree of attachment of toner to the sleeve surface is lowered (see FIG. 5) as compared to the second developing bias illustrated in FIG. 6, which has the same conditions as the first developing bias, except that the alternating-current voltage includes sinusoidal waves. Therefore, the occurrence of a trailing blur of a toner image can be more suppressed than the printer according to the first embodiment.

Third Embodiment

Figure 11:
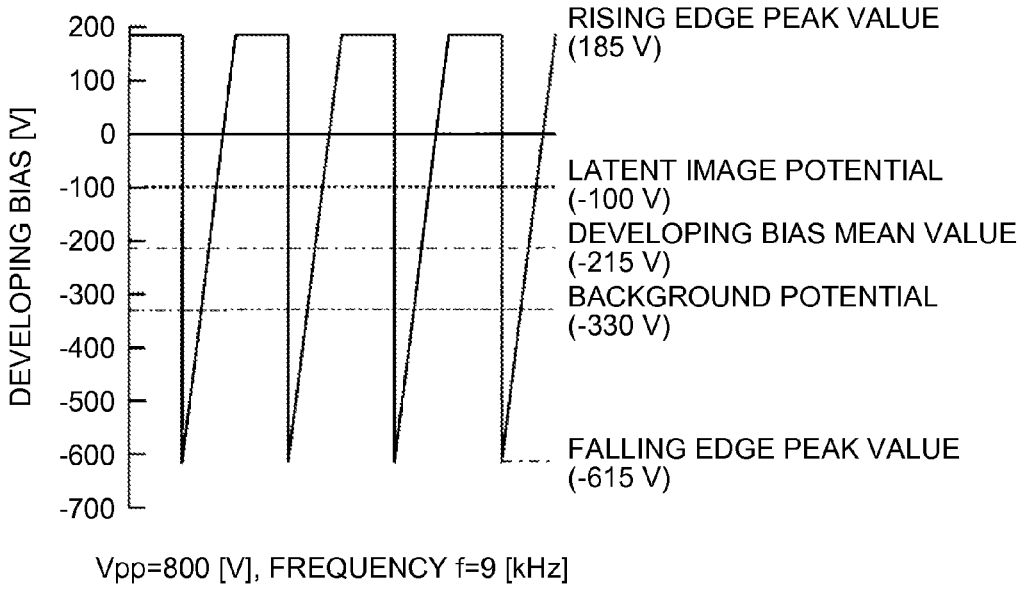
FIG. 11 is a graph illustrating a change over time of a second developing bias output from a developing bias supply unit of a printer according to a third embodiment.

FIG. 11 is a graph illustrating a change over time of a second developing bias output from the developing bias supply unit 25 of a printer according to a third embodiment. As illustrated in FIG. 11, the rising edges of the alternating-current voltage of the second developing bias are inclined lines more gradual than the perpendicular. In contrast, the falling edges are approximately perpendicular lines similarly to the rectangular wave. That is, the gradient of a falling edge at which the direction of an electric field is changed from the sleeve direction to the background portion direction is greater than the gradient of a rising edge. In such a configuration, the toner moving speed from the sleeve surface to the surface of a photosensitive element 3 is made faster than the toner moving speed from the surface of the photosensitive element 3 to the sleeve surface. In this way, the degree of attachment of toner to the sleeve surface may be decreased and a trailing blur of a toner image may be suppressed while maintaining satisfactory developing performance.

Figure 12:
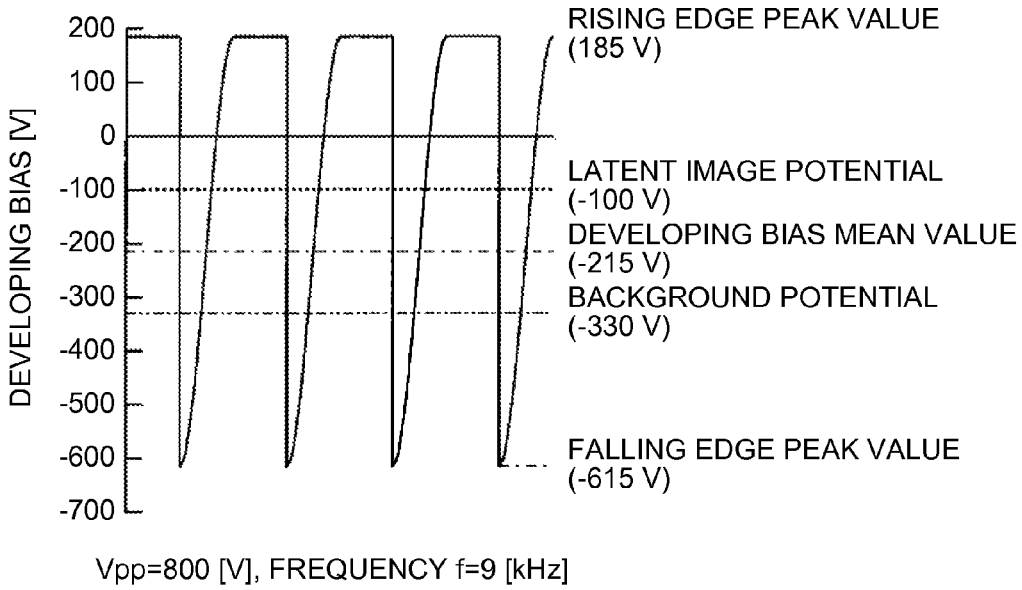
FIG. 12 is a graph illustrating a change over time of a second example of the second developing bias output from the developing bias supply unit of the printer according to the third embodiment.

In the graph of FIG. 11, although the rising edges are linear rising edges, the rising edges may be curved (sinusoidal) rising edges as illustrated in FIG. 12. In this case, since the gradient increases as compared to the linear rising edge, although the effect of decreasing the degree of attachment of toner to the sleeve surface deteriorates, the developing performance may be further improved.

Figure 13:
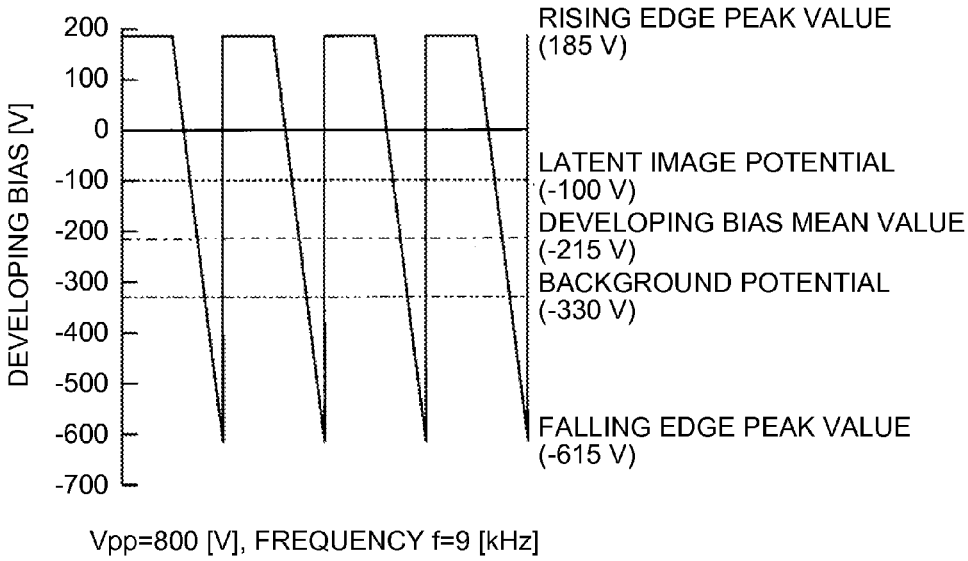
FIG. 13 is a graph illustrating a change over time of a second developing bias of a first comparative example.
Figure 14:
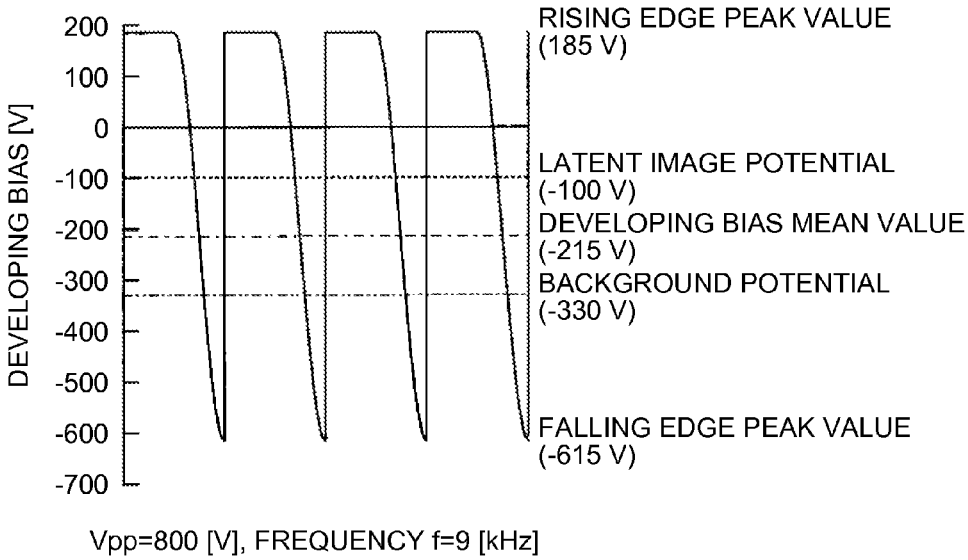
FIG. 14 is a graph illustrating a change over time of a second developing bias of a second comparative example.

If the magnitude relation of gradient is reversed from that of FIGS. 11 and 12 to obtain the graphs illustrated in FIGS. 13 and 14, problems may occur contradictory to the effect obtained when FIGS. 11 and 12 are employed. Specifically, as in the case of the graphs illustrated in FIGS. 13 and 14, when the gradient of a falling edge at which the direction of an electric field is changed from the sleeve direction to the background portion direction is made smaller than the gradient of the rising edge, the toner moving speed from the sleeve surface to the surface of the photosensitive element 3 becomes slower than the toner moving speed from the surface of the photosensitive element 3 to the sleeve surface. As a result, developing performance deteriorates, and the attachment of toner to the sleeve surface and the occurrence of a trailing blur of a toner image are accelerated.

As described above, in the printer according to the exemplary embodiment, the developing bias supply unit 25 is configured to output an alternating-current voltage having the same peak-to-peak value Vpp as the alternating-current voltage of the first developing bias as the alternating-current voltage (alternating-current component) of the second developing bias. With such a configuration, as described above, toner can be made to be satisfactorily attached to the edge of a character and a narrow line and the occurrence of the disappearance of the edge of the character and the narrow line may be suppressed.

In the printer according to the second embodiment, the developing bias supply unit 25 is configured to output a triangular alternating-current voltage as the alternating-current voltage of the second developing bias. With such a configuration, as described above, the occurrence of a trailing blur of a toner image can be more suppressed than when outputting a sinusoidal alternating-current voltage.

In the printer according to the first embodiment, the developing bias supply unit 25 is configured to output a sinusoidal alternating-current voltage as the alternating-current voltage of the second developing bias. With such a configuration, as described above, a circuit that outputs the second developing bias can be configured using a general power supply circuit which is available on the market. Moreover, the developing capability can be improved as compared to when outputting a triangular alternating-current voltage.

In the printer according to the third embodiment, the developing bias supply unit 25 is configured to output an alternating-current voltage of the developing bias so that the gradient of one of the rising and falling edges of the waveform, at which the direction of an electric field between the second developing sleeve 16 and the background portion of the photosensitive element 3 is changed to a direction in which toner is moved toward the background portion is greater than the gradient of the other edge as the alternating-current voltage of the second developing bias. With such a configuration, as described above, the degree of attachment of toner to the sleeve surface may be decreased and a trailing blur of a toner image may be suppressed while maintaining satisfactory developing performance.

In these embodiments, even when a toner image results in a developing density deficiency due to an insufficient amount of supplied toner during the first developing process using the first developer carrier, since the toner image is further developed by the second developing process using the second developer carrier, the developing density is increased. In addition, by applying a developing bias including an alternating-current component as the developing bias applied in each developing process, the toner is made easy to move from the developer toward the latent image to thereby improve developing efficiency as compared to when applying a developing bias including only a direct-current component. As a result, the occurrence of a developing density deficiency can be suppressed without moving the surface of the developer carrier at a high speed. Therefore, a toner scraping action resulting from high-speed surface movement of the developer carrier may be suppressed and narrow-line images can be reproduced satisfactorily.

In these embodiments, the surfaces of the first and second developer carriers are moved in the same direction as and at a faster linear speed than the latent image carrier at the developing region. The developer carried on these surfaces can smoothly pass through the developing region. As a result, the occurrence of developing defects due to the developer staying in the developing region for a long period can be suppressed.

In these embodiments, an alternating-current component formed by a non-rectangular wave is applied to the second developer carrier as the alternating-current component of the second developing bias. In the alternating-current component, the gradient of one of the rising and falling edges thereof, at which the direction of the electric field between the second developer carrier and the latent image carrier is changed to a direction in which toner is moved from the latent image carrier toward the second developer carrier is more gradual than the perpendicular. Therefore, as compared to a rectangular wave having a perpendicular gradient, the toner in the developer of the second developer carrier is more slowly moved from the latent image carrier toward the second developer carrier. As a result, as compared to an alternating-current component formed by a rectangular wave, when the surface of the second developer carrier faces a relatively large non-image portion on the surface of the latent image carrier, the toner in the developer is more suppressed from moving from the surface of the carrier particles toward the surface of the second developer carrier. In this way, as compared to the related art in which an alternating-current component formed by a rectangular wave is output as the alternating-current component of the second developing bias, a developer in which toner is made easy to be attached to the latent image of the latent image carrier is supplied to the trailing end of the latent image. Thus, a trailing blur of a toner image can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a first developer carrying means for performing a first developing process of developing a latent image on a latent image carrying means with a developer containing toner and carrier particles, the developer being carried on a surface of the first developer carrying means that is moved in a same direction as a moving direction of the latent image carrier at a faster linear speed than the latent image carrying means at a first developing region facing the latent image carrying means;

a second developer carrying means for performing a second developing process of further developing a toner image obtained by the first developing process with a developer carried on a surface of the second developer carrying means that is moved in a same direction as a moving direction of the image carrier at a faster linear speed than the latent image carrier at a second developing region facing the latent image carrying means; and a bias output means for outputting a developing bias to be applied to the second developer carrying means, the developing bias including a direct-current component and a non-rectangular alternating-current component whose waveform has an edge at which a direction of an electric field between the second developer carrying means and a background portion of the latent image carrying means is changed to a direction in which the toner is moved from the background portion toward the second developer carrying means, the edge of the waveform having a gradient more gentle than that of a rectangular wave.

2. The developing device according to claim 1, wherein the bias output means is configured to output the non-rectangular alternating-current component having the same peak-to-peak value as an alternating-current component of a developing bias to be applied to the first developer carrying means.

3. The developing device according to claim 2, wherein the bias output means is configured to output an alternating-current component having a triangular waveform as the non-rectangular alternating-current component for the second developer carrying means.

4. The developing device according to claim 2, wherein the bias output means is configured to output an alternating-current component having a sinusoidal waveform as the non-rectangular alternating-current component for the second developer carrying means.

5. The developing device according to claim 2, wherein the edge of the waveform is one of a rising edge and a falling edge of the waveform, and wherein the bias output means is configured to output the alternating-current component in which the gradient of the one of the edges is greater than that of the other edge.

6. An image forming apparatus comprising:

the developing device according to claim 1, the developing device being configured to develop the latent image carried on the latent image carrying means to obtain the toner image; and the latent image carrying means for carrying the latent image.

7. The developing device according to claim 2, wherein the bias output means is configured to output the non-rectangular alternating-current component having a different peak-to-peak value as an alternating-current component of a developing bias to be applied to the first developer carrying means.

8. A developing device comprising:

a first developer carrier configured to perform a first developing process of developing a latent image on a latent image carrier with a developer containing toner and carrier particles, the developer being carried on a surface of the first developer carrier that is moved in a same direction as a moving direction of the latent image carrier at a faster linear speed than the latent image carrier at a first developing region facing the latent image carrier;

a second developer carrier configured to perform a second developing process of further developing a toner image obtained by the first developing process with a developer carried on a surface of the second developer carrier that is moved in a same direction as a moving direction of the image carrier at a faster linear speed than the latent image carrier at a second developing region facing the latent image carrier; and a bias output unit configured to output a developing bias to be applied to the second developer carrier, the developing bias including a direct-current component and a non-rectangular alternating-current component whose waveform has an edge at which a direction of an electric field between the second developer carrier and a background portion of the latent image carrier is changed to a direction in which the toner is moved from the background portion toward the second developer carrier, the edge of the waveform having a gradient more gentle than that of a rectangular wave.

9. The developing device according to claim 8, wherein the bias output unit is configured to output the non-rectangular alternating-current component having the same peak-to-peak value as an alternating-current component of a developing bias to be applied to the first developer carrier.

10. The developing device according to claim 9, wherein the bias output unit is configured to output an alternating-current component having a triangular waveform as the non-rectangular alternating-current component for the second developer carrier.

11. The developing device according to claim 9, wherein the bias output unit is configured to output an alternating-current component having a sinusoidal waveform as the non-rectangular alternating-current component for the second developer carrier.

12. The developing device according to claim 9, wherein the edge of the waveform is one of a rising edge and a falling edge of the waveform, and wherein the bias output unit is configured to output the alternating-current component in which the gradient of the one of the edges is greater than that of the other edge.

13. An image forming apparatus comprising:

the developing device according to claim 8, the developing device being configured to develop the latent image carried on the latent image carrier to obtain the toner image; and the latent image carrier configured to carry the latent image.

14. The developing device according to claim 9, wherein the developing bias to be applied to the first developer carrier and the developing bias to be applied to the second developer carrier are different values.

15. A developing method comprising:

performing, by a first developer carrier, a first developing process of developing a latent image on a latent image carrier with a developer containing toner and carrier particles, the developer being carried on a surface of the first developer carrier that is moved in a same direction as a moving direction of the latent image carrier at a faster linear speed than the latent image carrier at a first developing region facing the latent image carrier;

performing, by a second developer carrier, a second developing process of further developing a toner image obtained by the first developing process with a developer carried on a surface of the second developer carrier that is moved in a same direction as a moving direction of the image carrier at a faster linear speed than the latent image carrier at a second developing region facing the latent image carrier; and outputting, by a bias output unit a developing bias to the second developer carrier, the developing bias including a direct-current component and a non-rectangular alternating-current component whose waveform has an edge at which a direction of an electric field between the second developer carrier and a background portion of the latent image carrier is changed to a direction in which the toner is moved from the background portion toward the second developer carrier, the edge of the waveform having a gradient more gentle than that of a rectangular wave.

16. The developing method according to claim 15, wherein the non-rectangular alternating-current component has the same peak-to-peak value as an alternating-current component of a developing bias to be applied to the first developer carrier.

17. The developing method according to claim 16, wherein the non-rectangular alternating-current component has a triangular waveform.

18. The developing method according to claim 16, wherein the non-rectangular alternating-current component has a sinusoidal waveform.

19. The developing method according to claim 16, wherein the edge of the waveform is one of a rising edge and a falling edge of the waveform, and wherein the gradient of the one of the edges is greater than that of the other edge.

20. The developing method of claim 16 wherein the developing bias to be applied to the first developer carrier and the developing bias to be applied to the second developer carrier are different values.

* * * * *